United States Patent [19]

Nakahara et al.

[11] Patent Number: 4,532,896

[45] Date of Patent: Aug. 6, 1985

[54] TWO-CYCLE ENGINE

[75] Inventors: Kichio Nakahara; Hiroshi Matsui; Harumichi Yoshiyama, all of Aichi, Japan

[73] Assignee: NGK Spark Plug Co., Ltd., Nagoya, Japan

[21] Appl. No.: 552,826

[22] Filed: Nov. 17, 1983

[30] Foreign Application Priority Data

Nov. 18, 1982 [JP] Japan ..... 57-202307

[51] Int. Cl.[3] ..... F02B 75/08

[52] U.S. Cl. ..... 123/193 H; 123/668

[58] Field of Search ..... 123/668, 669, 193 R, 123/193 M, 193 CH, 193 C

[56] References Cited

U.S. PATENT DOCUMENTS 3,657,078 4/1972 Schweikmer ..... 123/193 C
4,074,671 2/1978 Pennila ..... 123/668
4,254,621 3/1981 Nagumo ..... 123/669
4,398,527 8/1983 Rynbrandt ..... 123/193 M

FOREIGN PATENT DOCUMENTS 0147036 6/1952 Australia ..... 123/669

*Primary Examiner*—Craig R. Feinberg
*Attorney, Agent, or Firm*—Finnegan, Henderson, Farabow, Garrett & Dunner

[57] ABSTRACT

An improved two-cycle engine in which the inner wall of the head of the combustion cylinder facing the combustion chamber is formed of a heat-insulating ceramic element which surrounds the tip of a mounting portion of the spark plug of the cylinder. The tip of the spark plug should be threadless in the area surrounded by the ceramic element. The ceramic element is preferably a sintered product made of silicon nitride, zirconia, sialon, alumina or silicon carbide.

1 Claim, 6 Drawing Figures

TWO-CYCLE ENGINE

BACKGROUND OF THE INVENTION

The present invention relates to a two-cycle engine that achieves improved fuel economy due to the addition of a ceramic element formed in the wall of the head of the cylinder facing the combustion chamber.

It is conventionally known to use heat-insulating ceramic elements in all or some of the components that make up the combustion chamber of an engine such as the head of the cylinder, the cylinder block and the piston. The advantage of using ceramic elements is particularly great in diesel engines because such use increases the thermal efficiency and reduces the fuel consumption, particularly, achieving a more effective burning of low-grade fuels. However, if ceramic elements are used to form the combustion chamber of a four-cycle engine, little increase is attained in the power output, and instead, the temperature in the combustion chamber is increased to such an extent that knocking or preignition occurs easily.

The present inventors previously found that the performance of a two-cycle engine could be increased by forming the head of the cylinder with a heat-insulating ceramic material such as silicon nitride, zirconia or sialon. The ceramic material helps increase the temperature of the wall of the cylinder head facing the combustion chamber, promoting the evaporation into finer particles of the fuel in the intake air-fuel mixture and residual or burnt gas. As a result, a higher power output is attained from the engine while providing a greatly reduced fuel consumption. However, as the temperature in the combustion chamber is increased, the temperature of the spark plug also increases and hence knocking or preignition can occur easily.

SUMMARY OF THE INVENTION

As a result of various studies made to solve this problem, the present inventors have found that the performance of a two-cycle engine can be improved without causing knocking or preignition by providing a ceramic element embedded in the inner wall of the head of the cylinder facing the combustion chamber. The ceramic element is made of one of the materials listed above, and is so formed as to surround the tip of the mounting portion of the spark plug.

DESCRIPTION OF THE PREFERRED EMBODIMENTS

Figure 1:
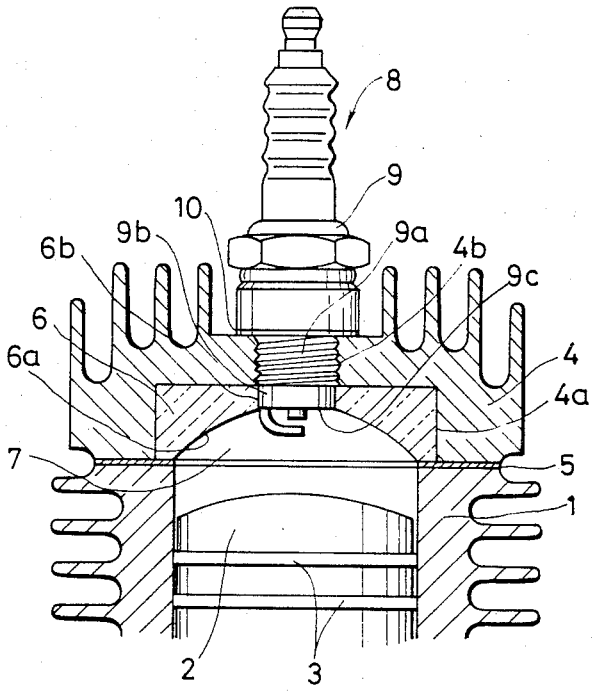
FIG. 1 shows in cross section the essential parts of a two-cycle engine according to one embodiment of the present invention.

The present invention will now be described with reference to preferred embodiments shown in the accompanying drawings. FIG. 1 shows in cross section the essential parts of a two-cycle engine according to one embodiment of the present invention wherein reference numeral 1 indicates a metal cylinder block; 2, a piston, typically made of an aluminum alloy, which reciprocates through the chamber defined by the cylinder block; 3, a piston ring; 4, the metal (aluminum or aluminum alloy) head of the cylinder which is fastened to the cylinder block by bolts (not shown) through a gasket; 6, a heat-insulating ceramic element, typically made of sintered silicon nitride, zirconia, sialon, alumina or silicon carbide, which is formed in the wall of the cylinder head which faces a combustion chamber 7 defined between the piston and the head of the cylinder. This ceramic element is cylindrically shaped, having a generally hemispherical inner surface **6*a* toward the combustion chamber, and is shrink fitted, optionally through a buffer, into a recess 4*a*** formed in the head of the cylinder.

Reference numeral 8 represents a spark plug having a mounting portion or metal shell 9. The threaded portion **9*a* is screwed into a female thread 4*b* cut into the center of the head of the cylinder. The tip 9*b* of the spark plug fits into a hole 6*b* in the ceramic element 6 with the face 9*c* of the extreme end of the mounting portion almost flush with the inner surface 6*a* of the ceramic element. The spark plug is mounted on the head of the cylinder through a gasket 10** with the center electrode projecting beyond the inner surface of the ceramic element.

Figure 2:
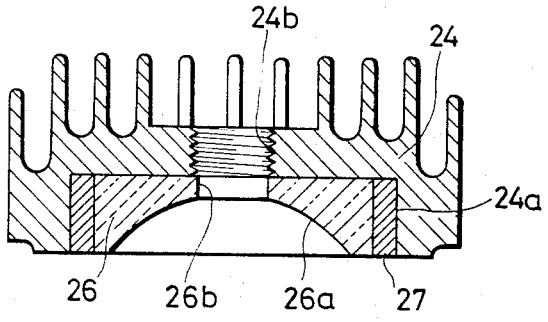
FIGS. 2 and 3 are cross sections showing other embodiments of the two-cycle engine of the present invention.
Figure 3:
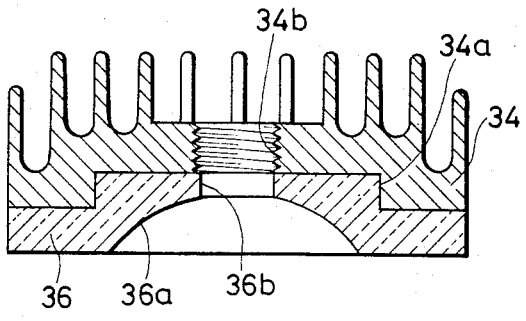
Figure 4:
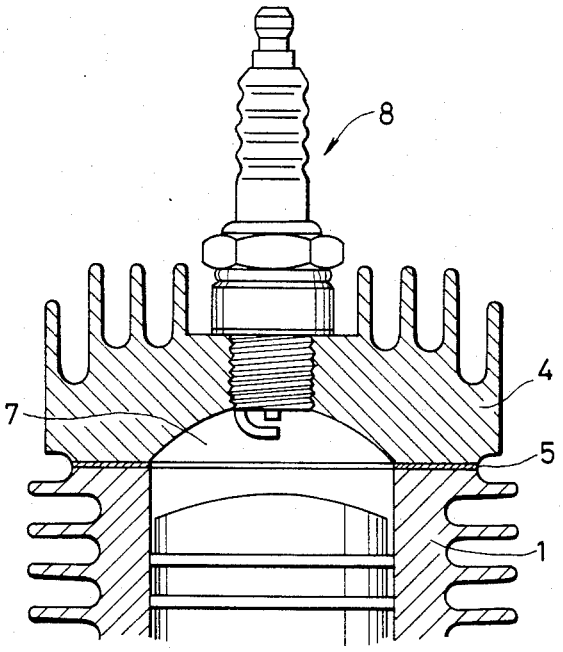
FIG. 4 shows in cross section the essential parts of the conventional two-cycle engine.

FIGS. 2 and 3 show other embodiments of a two-cycle engine of the present invention. In the embodiment of FIG. 2, the metal head 24 of the cylinder has a female thread **24*b* for receiving the spark plug and is provided with a recess 24*a* into which is press fitted an assembly of a cylindrical ceramic element 26 and an annular metal ring 27 that has been shrink fitted around the ceramic element. The ceramic element 26 has an inner wall 26*a* that faces the combustion chamber and a hole 26*b* which penetrates that wall. The metal ring 27** is made of a heat-resistant steel such as stainless steel.

In the embodiment of FIG. 3, the metal head 34 of the cylinder having a female thread **34*b* for receiving the spark plug is provided with a recess 34*a* into which is fitted a projection formed on a disk-shaped ceramic element 36 which has the same diameter as that of the head of the cylinder and which has as an inner wall 36*a* that faces the combustion chamber and a hole 36*b* which penetrates that wall. The ceramic element 36 in combination with the metal head 34 of the cylinder is mounted on the cylinder block of FIG. 1** with a gasket.

Conventionally, a ceramic coating is formed, for example, by thermal spraying, such as may be done on the inner wall of a metal cylinder head facing the combustion chamber. However, the resulting ceramic coating does not provide satisfactory heat-insulating properties, and hence is unable to achieve the purpose of the present invention. Furthermore, the ceramic element of the invention preferably has a thickness around the tip of the mounting portion of the spark plug of at least about 2 to 6 mm (axial direction). Comparison with a ceramic element formed on the inner wall of the cylinder head without covering the tip of the mounting portion of the spark plug has shown that unless the above requirement is met, the burning of the fuel-air mixture is not satisfactorily accelerated in the early stages of the growth of the flame nucleus.

Figure 5:
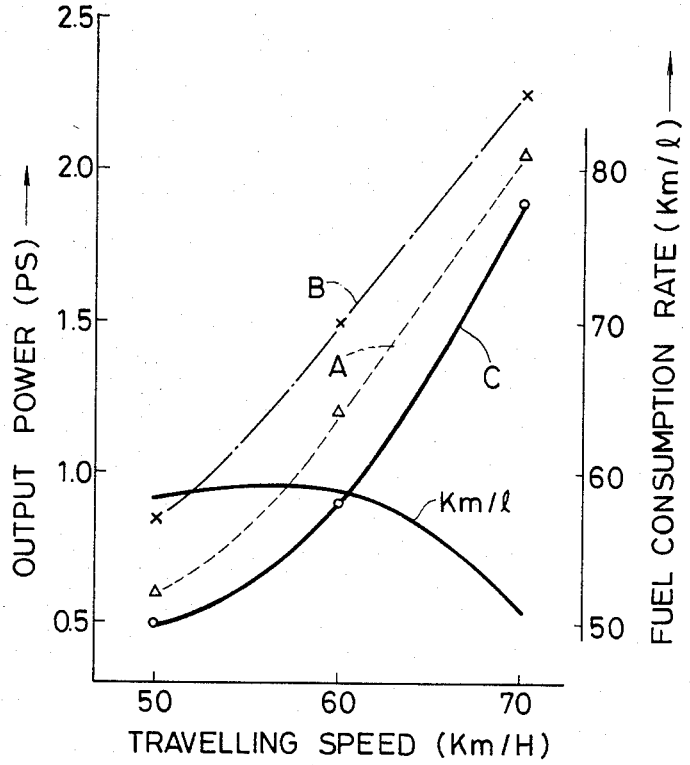
FIG. 5 is a power diagram for three types of cylinder heads, with the fuel economy taken as a parameter.

The performance of single-cylinder, two-cycle engine (FIG. 1) of the present invention was compared with a similar type engine but using a conventional aluminum cylinder head. Power data from this comparison is shown in FIG. 5 with the fuel consumption indicated as a parameter. The fuel economy data is given in FIG. 6 with the power indicated as a parameter. In each of the two figures, curve A refers to a case where the ceramic element was made of sintered silicon nitride having a thermal conductivity of 0.03 cal/cm.sec. degree C.; curve B refers to a case where the ceramic element was made of sintered, partially stabilized zirconia (0.006 cal/cm.sec. degree C.); and curve C refers to a case where the cylinder was made of aluminum (0.53 cal/cm. sec. degree C.). All cylinders tested had the same volume combustion chamber. The center electrode of each spark plug projected from the inner wall of the cylinder head by 3.0 mm, and the spark gap was set at 0.7 mm.

Figure 6:
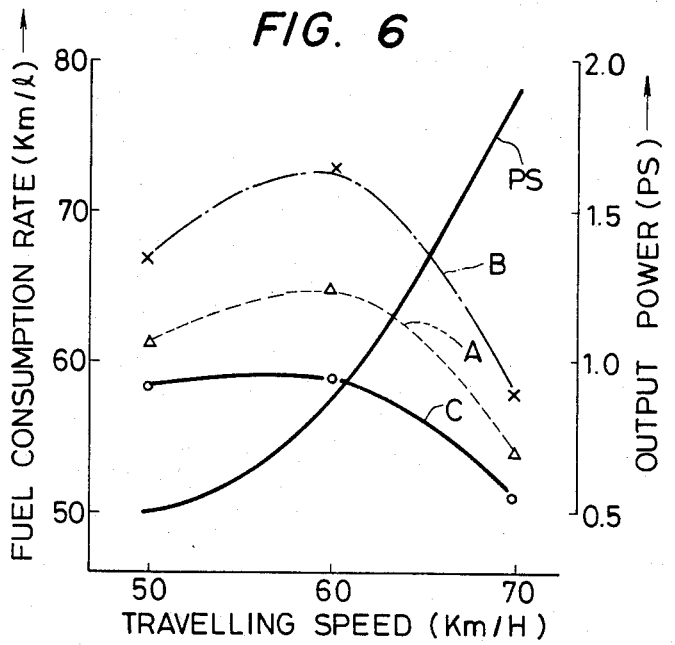
FIG. 6 is a fuel economy diagram with output power taken as a parameter.

As can be seen from FIG. 5, the cylinder head employing $Si_3N_4$ (curve A) and the cylinder head employing $ZrO_2$ (curve B) produced far greater power for the same fuel consumption at a given throttle position than the engine using the conventional aluminum cylinder head (curve C). The engine having the cylinder head in which $ZrO_2$ was used was more powerful than the one using $Si_3N_4$ because of the greater heat-insulating properties of $ZrO_2$. As FIG. 6 shows, the two engines of the present invention also achieved a significant fuel economy for the same power at a given throttle position with partial loads applied at various engine speeds. The effectiveness of the cylinder head of the present invention is not appreciable during idling when no load is applied, but a significant improvement in engine performance is achieved under partial loading. Other advantages of the present invention are protection against irregular or erratic combustion and reduced smoke emission. Experiments have shown that the cylinder head configuration of FIG. 2, wherein the ceramic element was fitted in an aluminum head through a ring of stainless steel or other material having a smaller thermal conductivity and thermal expansion coefficient than alumimum, retained more heat produced a greater power and achieved more fuel economy than the configurations shown in FIGS. 1 and 3 wherein the ceramic element was directly fitted in the head of the cylinder. The embodiment of FIG. 2 is also effective in minimizing the chance of accidental breakage of the ceramic element.

As described above, a two-cycle engine of the present invention is characterized by forming a heat-insulating ceramic element in the inner wall of the combustion chamber in such a manner that the ceramic element surrounds the tip of the mounting portion of the spark plug. This configuration is effective to minimize the occurrence of irregular combustion, attain a higher power output and realize greater fuel economy at partial loads on the engine. As further advantages, the engine of the present invention provides minimized knocking and preignition under practical operating conditions.

We claim:

1. A cylinder head for a two-cycle engine comprising:

a cylinder head having an interior portion forming a combustion chamber, an opening in said head into said combustion chamber disposed to receive a spark plug, the inner surface of said combustion chamber adjacent said opening consisting essentially of a layer of sintered ceramic material selected from the group consisting of silicon nitride, zirconia, sialon, alumina and silicon carbide, wherein said layer has a thickness in the range from about 2 to 6 millimeters, said opening comprising an outer threaded portion and an inner unthreaded portion confined solely within said ceramic layer; and a spark plug interposed within said opening, said spark plug having a tip comprised of an outer threaded portion, an inner unthreaded portion and electrodes, said unthreaded portion of said spark plug peripherally engaging said unthreaded portion of said opening within said ceramic layer.

* * * * *